US010925397B2

(12) United States Patent
Chen et al.

(10) Patent No.: US 10,925,397 B2
(45) Date of Patent: Feb. 23, 2021

(54) SLIDE RAIL MECHANISM

(71) Applicants: KING SLIDE WORKS CO., LTD., Kaohsiung (TW); KING SLIDE TECHNOLOGY CO., LTD., Kaohsiung (TW)

(72) Inventors: Ken-Ching Chen, Kaohsiung (TW); Hsiu-Chiang Liang, Kaohsiung (TW); Chun-Chiang Wang, Kaohsiung (TW)

(73) Assignees: King Slide Works Co., Ltd., Kaohsiung (TW); King Slide Technology Co., Ltd., Kaohsiung (TW)

( * ) Notice: Subject to any disclaimer, the term of this patent is extended or adjusted under 35 U.S.C. 154(b) by 0 days.

(21) Appl. No.: 16/229,229

(22) Filed: Dec. 21, 2018

(65) Prior Publication Data

US 2020/0100589 A1 Apr. 2, 2020

(30) Foreign Application Priority Data

Sep. 27, 2018 (TW) ..... 107134578

(51) Int. Cl.
*A47B 88/407* (2017.01)

(52) U.S. Cl.
CPC ..... *A47B 88/407* (2017.01)

(58) Field of Classification Search
CPC ..... A47B 88/407; A47B 2210/0056; A47B 88/427; A47B 2088/4276; A47B 88/956; A47B 2210/0054; A47B 2088/4278; A47B 2088/4272; A47B 2088/4274; A47B 88/49; A47B 88/423; A47B 88/477; A47B 2210/091; A47B 2230/0014; A47B 2088/4235; A47B 88/40; A47B 88/483; A47B 88/57
See application file for complete search history.

(56) References Cited

U.S. PATENT DOCUMENTS

| | | | | |
|---|---|---|---|---|
| 5,375,922 | A * | 12/1994 | Brustle | A47B 88/427 312/330.1 |
| 5,439,283 | A * | 8/1995 | Schroder | A47B 88/407 312/334.38 |
| 8,220,884 | B2 * | 7/2012 | Berger | A47B 88/427 312/334.4 |
| 8,727,460 | B2 * | 5/2014 | Grabher | E05F 5/02 312/333 |
| 8,854,769 | B1 * | 10/2014 | Liang | A47B 88/427 360/125.51 |
| 8,919,711 | B2 | 12/2014 | Holzer et al. | |
| 8,979,223 | B2 | 3/2015 | Huang | |
| 8,991,952 | B2 * | 3/2015 | Salice | A47B 88/427 312/334.4 |
| 9,125,490 | B2 | 9/2015 | Haemmerle et al. | |
| 9,179,771 | B2 | 11/2015 | Haemmerle et al. | |
| 9,259,087 | B1 * | 2/2016 | Hsiao | A47B 88/427 |
| 9,861,195 | B2 * | 1/2018 | Lucas | A47B 88/95 |

(Continued)

*Primary Examiner* — Hiwot E Tefera
(74) *Attorney, Agent, or Firm* — Rosenberg, Klein & Lee

(57) ABSTRACT

A slide rail mechanism includes a slide rail and a connection device. The connection device includes a first component, a second component, and an operating member. The first component is connected to the slide rail. The second component can be moved with respect to the first component. The operating member is configured to laterally displace, and thereby adjust, the second component with respect to the slide rail.

15 Claims, 16 Drawing Sheets

(56) References Cited

U.S. PATENT DOCUMENTS

| | | | | |
|---|---|---|---|---|
| 9,907,399 | B2 | 3/2018 | Lucas | |
| 10,244,867 | B2 * | 4/2019 | Liang | A47B 88/427 |
| 10,631,637 | B2 * | 4/2020 | Lucas | A47B 88/427 |
| 10,779,648 | B2 * | 9/2020 | Lucas | A47B 88/493 |
| 2002/0158557 | A1 * | 10/2002 | Weichelt | A47B 88/427<br>312/334.4 |
| 2003/0234603 | A1 * | 12/2003 | Salice | A47B 88/407<br>312/334.5 |
| 2004/0095047 | A1 * | 5/2004 | Salice | A47B 88/427<br>312/332.1 |
| 2009/0251037 | A1 * | 10/2009 | Berger | A47B 88/427<br>312/334.1 |
| 2012/0292465 | A1 * | 11/2012 | Holzer | A47B 88/427<br>248/201 |
| 2013/0154463 | A1 * | 6/2013 | Henscheid | A47B 88/427<br>312/330.1 |
| 2013/0257244 | A1 * | 10/2013 | Salice | A47B 88/423<br>312/319.1 |
| 2013/0293078 | A1 * | 11/2013 | Haemmerle | A47B 88/40<br>312/333 |
| 2014/0055021 | A1 * | 2/2014 | Grabherr | A47B 88/427<br>312/334.8 |
| 2014/0314347 | A1 * | 10/2014 | Huang | A47B 88/407<br>384/22 |
| 2015/0275963 | A1 * | 10/2015 | Petersson | A47B 88/40<br>384/22 |
| 2016/0025124 | A1 * | 1/2016 | Roedder | F16B 12/04<br>403/14 |
| 2017/0347794 | A1 * | 12/2017 | McGregor | A47B 88/49 |
| 2019/0216219 | A1 * | 7/2019 | Chen | A47B 88/423 |
| 2019/0261773 | A1 * | 8/2019 | Chen | A47B 88/483 |

* cited by examiner

SLIDE RAIL MECHANISM

FIELD OF THE INVENTION

The present invention relates to a slide rail and more particularly to an adjustable slide rail mechanism.

BACKGROUND OF THE INVENTION

Slide rail mechanisms have been applied extensively, such as to furniture and to rack systems designed for electronic equipment. Take furniture for example. A slide rail mechanism for use in a cabinet typically includes a stationary rail and a movable rail that can be displaced longitudinally with respect to the stationary rail. Generally, the stationary rail is fixed on the body of the cabinet, and the movable rail is configured to carry a drawer so that the drawer can be moved with respect to the cabinet body via the movable rail.

Sometimes, the market requires slide rail mechanisms to be adjustable in order to deal with engineering tolerances of slide rails or furniture parts.

SUMMARY OF THE INVENTION

The present invention relates to a slide rail mechanism that can be adjusted.

According to one aspect of the present invention, a slide rail mechanism includes a slide rail and a connection device. The connection device includes a first component, a second component, and an operating member. The first component is detachably connected to the slide rail. The second component can be moved with respect to the first component. The operating member is configured to transversely displace, and thereby adjust, the second component with respect to the longitudinal length direction of the slide rail.

Preferably, the connection device further includes an engaging member movably mounted on the first component, and the first component is detachably connected to the slide rail via the engaging member.

Preferably, the engaging member is pivotally connected to the first component, includes at least one engaging portion for engaging with a corresponding structure of the slide rail, and is pressed against the first component via an elastic portion.

Preferably, the first component includes a fastening portion to be fastened to the slide rail at a position adjacent to a front portion of the slide rail.

Preferably, the first component and the second component can be transversely displaced with respect to each other to a limited extent thanks to the cooperation between a first guiding structure and a second guiding structure.

Preferably, the first guiding structure is a protuberance, and the second guiding structure is a slot, wherein the protuberance is smaller than the slot.

Preferably, the slide rail mechanism includes another slide rail (hereinafter the second mentioned slide rail), and the first mentioned slide rail can be longitudinally displaced with respect to the second mentioned slide rail.

Preferably, the operating member is configured to transversely displace, and thereby adjust, the second component by means of eccentric adjustment.

Preferably, the operating member includes a first portion, a second portion, and an operating portion, wherein the first portion is a substantially circular protrusion and the second portion is connected to the first portion at a position other than the center of circle of the first portion. It is also preferable that one of the first component and the second component includes a first structure, that the other of the first component and the second component includes a second structure, that the first portion of the operating member is inserted in the first structure, and that the second portion of the operating member is inserted in the second structure.

Preferably, the second component is configured to be connected to a first furniture part, and the second mentioned slide rail is configured to be connected to a second furniture part.

Preferably, the slide rail mechanism further includes a stopping structure disposed on one of the first mentioned slide rail and the second mentioned slide rail and a fitting detachably mounted on the other of the first mentioned slide rail and the second mentioned slide rail. When the fitting is mounted on the other of the first mentioned slide rail and the second mentioned slide rail, and the first mentioned slide rail is retracted with respect to the second mentioned slide rail, the fitting is brought into abutment against the stopping structure in order for the first mentioned slide rail to be at one of a plurality of different longitudinal positions with respect to the second mentioned slide rail or at the same longitudinal position with respect to the second mentioned slide rail.

Preferably, the slide rail mechanism further includes a base connected to the other of the first mentioned slide rail and the second mentioned slide rail, and the fitting is detachably mounted at the base.

Preferably, the fitting includes an adjustment device, and the adjustment device includes an adjusting element mounted at the base in an adjustable manner. When the first mentioned slide rail is retracted with respect to the second mentioned slide rail, the adjusting element is brought into abutment against the stopping structure.

Preferably, the adjustment device further includes a mounting element, the adjusting element is mounted at the base via the mounting element, and the mounting element and the adjusting element are threadedly connected with respect to each other.

Preferably, the fitting includes a stopper. When the stopper is mounted at the base, and the first mentioned slide rail is retracted with respect to the second mentioned slide rail, the stopper is brought into abutment against the stopping structure in order for the first mentioned slide rail to be at the same longitudinal position with respect to the second mentioned slide rail.

DETAILED DESCRIPTION OF THE INVENTION

Figure 1:
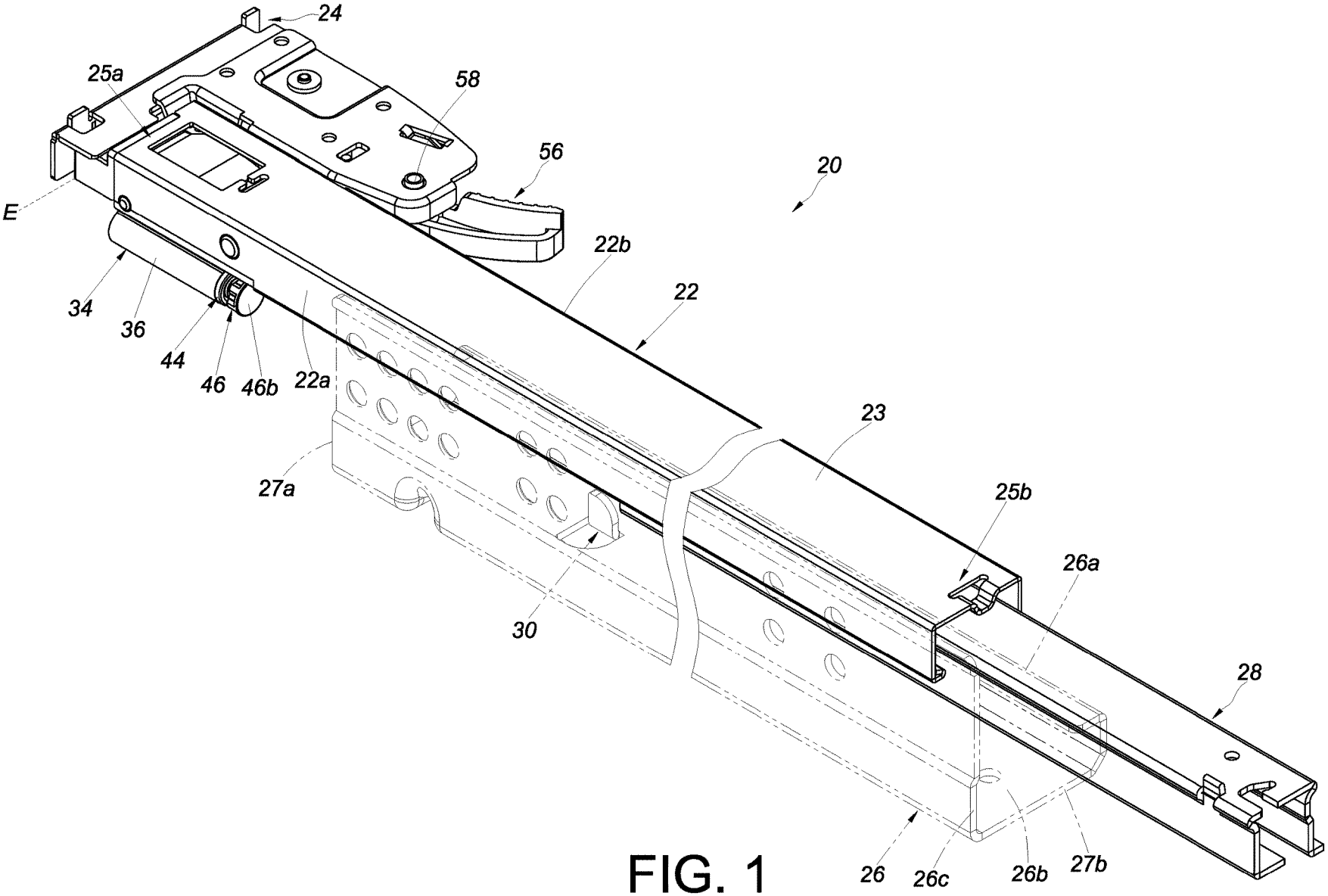
FIG. 1 is a perspective view of the slide rail mechanism according to an embodiment of the present invention.
Figure 2:
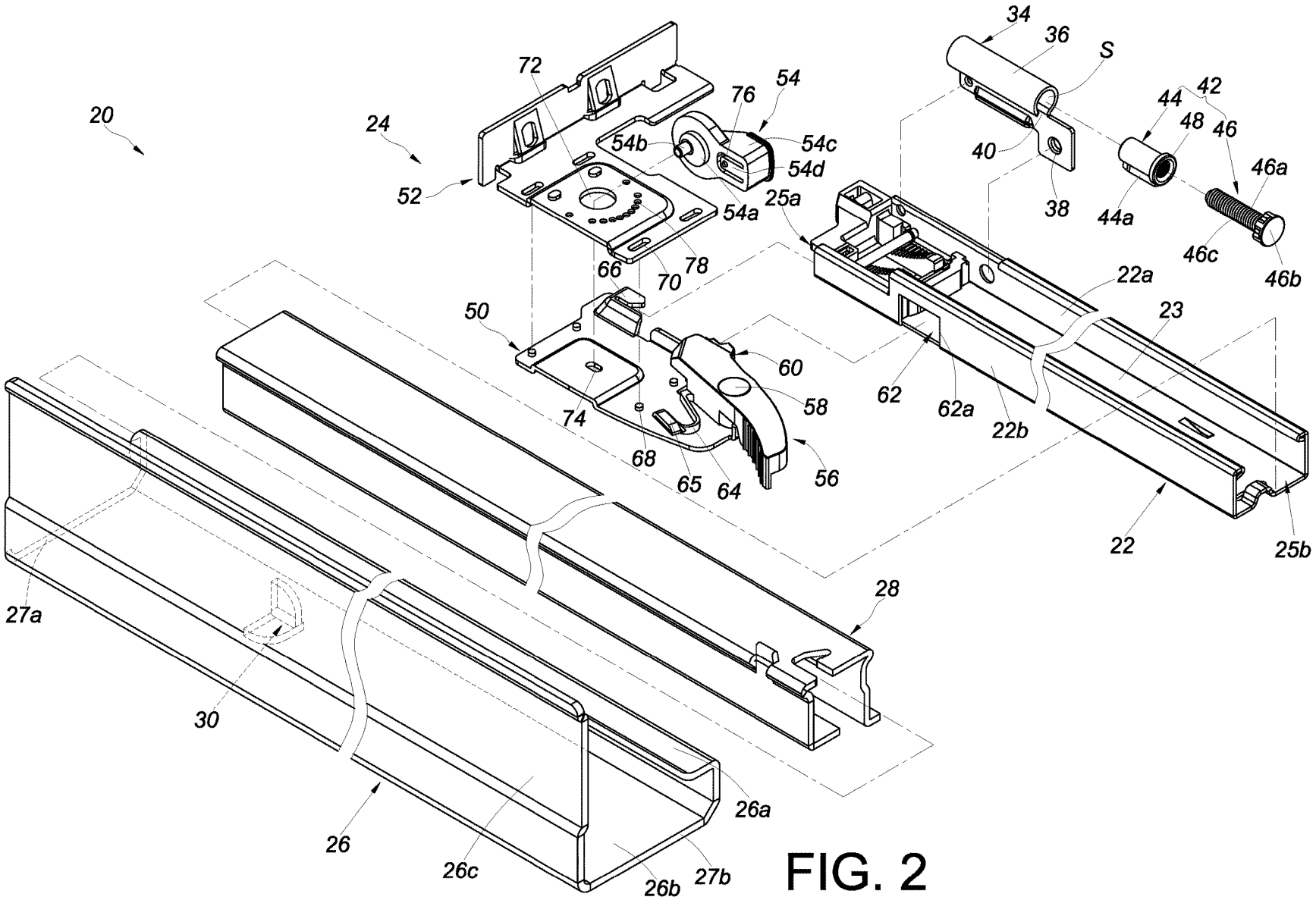
FIG. 2 is an exploded perspective view of the slide rail mechanism according to the embodiment of the present invention.

Referring to FIG. 1 and FIG. 2, the slide rail mechanism 20 according to an embodiment of the present invention includes a first rail 22 (also referred to as a slide rail in the appended claims) and a connection device 24. Preferably, the slide rail mechanism 20 further includes a second rail 26 (also referred to as another slide rail in the claims), a third rail 28 (also known as an intermediate rail), a stopping structure 30, a base 34, and a fitting.

The second rail 26 has a rail portion 26*a*, an extension portion 26*b*, and a vertical portion 26*c*. The extension portion 26*b* is connected between the rail portion 26*a* and the vertical portion 26*c*. The first rail 22 and the second rail 26 can be longitudinally displaced with respect to each other. Preferably, the third rail 28 is movably mounted between (the rail portion 26*a* of) the second rail 26 and the first rail 22 to increase the distance for which the first rail 22 can be longitudinally displaced with respect to the second rail 26. More specifically, the first rail 22 has a front portion 25*a* and a rear portion 25*b*. Preferably, the first rail 22 includes a first sidewall 22*a*, a second sidewall 22*b*, and a longitudinal wall 23 connected between the first sidewall 22*a* and the second sidewall 22*b*. The first rail 22 can be displaced to an extended position E with respect to the second rail 26, as shown in FIG. 1.

The stopping structure 30 is disposed on one of the first rail 22 and the second rail 26. Here, the stopping structure 30 is disposed on the extension portion 26*b* of the second rail 26 by way of example. The stopping structure 30 may be, but is not limited to, a protruding block or a stop wall. The second rail 26 has a front portion 27*a* and a rear portion 27*b*. Preferably, the stopping structure 30 is disposed on the second rail 26 at a position adjacent to the front portion 27*a*.

The base 34 is connected to the other of the first rail 22 and the second rail 26. Here, the base 34 is connected to the first rail 22 by way of example. The base 34 may be connected to the first rail 22 in a fixed or detachable manner without limitation. Preferably, the base 34 is connected to the first rail 22 at a position adjacent to the front portion 25*a*. Preferably, the base 34 is longitudinally disposed and includes an encircling wall 36 and a connecting portion 38 connected to the encircling wall 36. The encircling wall 36 encircles and thereby defines a space S. The encircling wall 36 is connected to the first sidewall 22*a* of the first rail 22 via the connecting portion 38 (e.g., by threaded connection, soldering, or riveting). In this embodiment, the encircling wall 36 has a semi-annular contour by way of example and includes a notch 40 in communication with the space S; in practice, however, the encircling wall 36 is not necessarily so configured.

The fitting is detachably mounted on the first rail 22 and includes an adjustment device 42. More specifically, the adjustment device 42 includes a mounting element 44 and an adjusting element 46. The mounting element 44 and the adjusting element 46 are connected in such a way that they can be adjusted with respect to each other. For example, the mounting element 44 and the adjusting element 46 are threadedly connected with respect to each other. The mounting element 44 is received and mounted in the space S of the base 34 and has a first screw thread 48. Preferably, the mounting element 44 has a stop portion 44*a* inserted in the notch 40 of the base 34 such that the mounting element 44 is engaged with the base 34. The adjusting element 46 includes a body 46*a* and preferably also a head 46*b* connected to the body 46*a*, wherein the body 46*a* has a second screw thread 46*c* and the head 46*b* is larger than the body 46*a*. Once the body 46*a* of the adjusting element 46 is threadedly connected to the mounting element 44 through engagement between the second screw thread 46*c* and the first screw thread 48, the head 46*b* stays outside the space S of the base 34. The adjustable connection between the adjusting element 46 and the mounting element 44 allows the adjusting element 46 to be adjusted in position with respect to the mounting element 44 so that the length (longitudinal length) of the adjustment device 42 is adjustable. It should be added that, while the adjustability of this embodiment is made possible by the threaded connection between the adjusting element 46 and the mounting element 44, this threaded connection is not essential; for example, it is feasible for the adjusting element 46 and the base 34 to be threadedly connected instead. In other words, length adjustment does not necessarily depend on the mounting element 44. Length adjustment does not necessarily depend on threaded connection, either, provided that the length of the adjustment device 42 can be adjusted.

Figure 3:
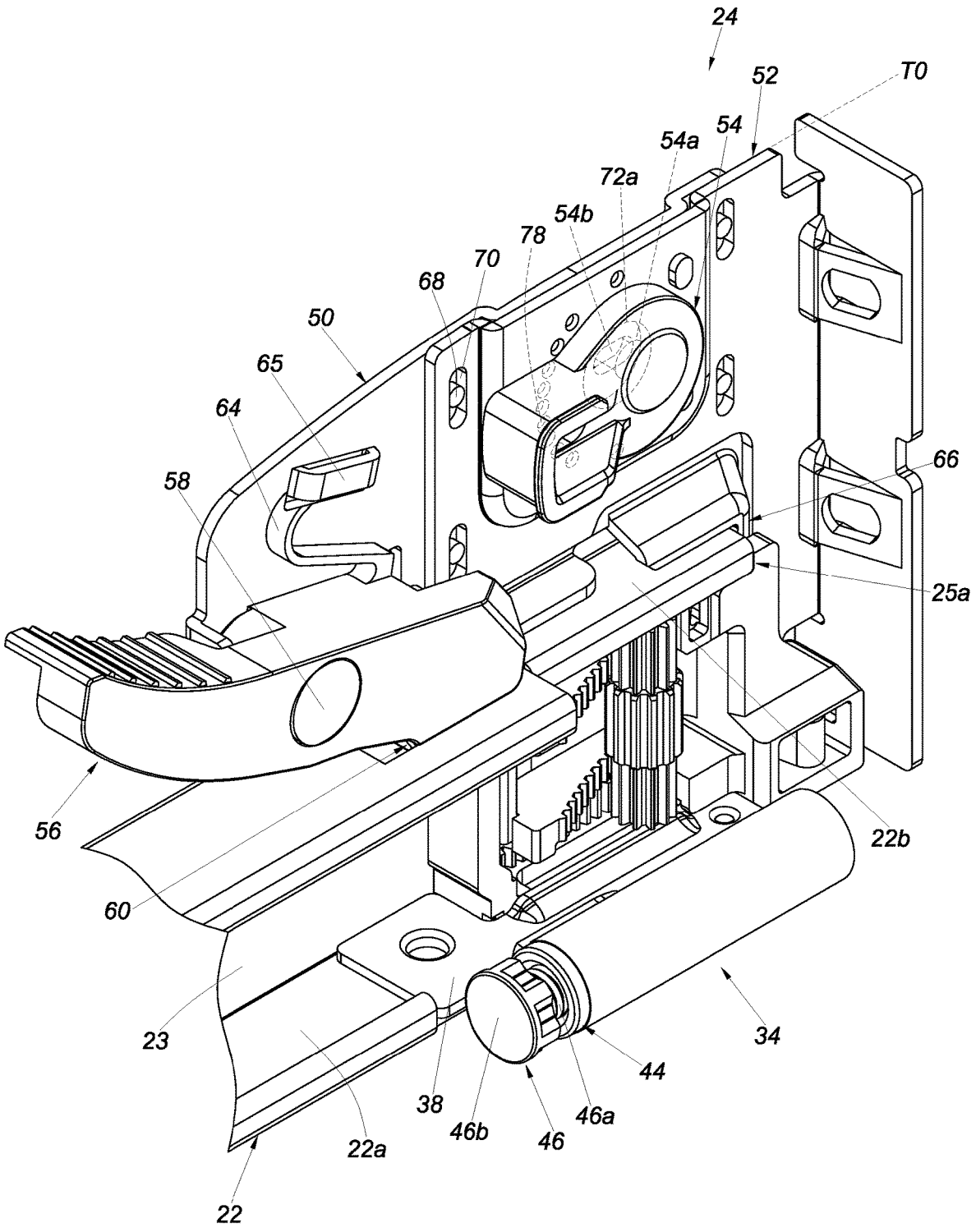
FIG. 3 is a perspective view of the connection device disposed on the first rail of the slide rail mechanism according to the embodiment of the present invention, showing a state in which the operating member of the connection device has yet to be operated.

As shown in FIG. 2 and FIG. 3, the connection device 24 includes a first component 50, a second component 52, and an operating member 54.

The first component 50 is connected to the first rail 22. For example, the first component 50 is detachably connected to the first rail 22, although in practice the connection need not be detachable. Preferably, the connection device 24 further includes an engaging member 56 movably mounted on the first component 50. For example, the engaging member 56 is pivotally connected to the first component 50 via a shaft 58. The first component 50 is detachably connected to the first rail 22 via the engaging member 56. More specifically, the engaging member 56 includes at least one engaging portion 60 for engaging with a corresponding structure 62 of the second sidewall 22*b* of the first rail 22, and the engaging member 56 is pressed against a portion 65 of the first component 50 via an elastic portion 64 and is thereby kept at a predetermined position. Preferably, the at least one engaging portion 60 is a projection with a step-like contour, and the corresponding structure 62 of the first rail 22 is a hole. The at least one engaging portion 60 is engageable with a hole wall 62*a* of the corresponding structure 62 of the first rail 22 by way of example but not limitation. Preferably, the first component 50 includes a fastening portion 66 (such as but not limited to a fastening hook) to be fastened to the second sidewall 22*b* of the first rail 22 at a position adjacent to the front portion 25*a* of the first rail 22 to help connect the first component 50 to the first rail 22 securely.

The second component 52 can be moved with respect to the first component 50. Preferably, the first component 50 and the second component 52 can be transversely displaced with respect to each other to a limited extent through the cooperation between a first guiding structure 68 of the first component 50 and a second guiding structure 70 of the second component 52. Preferably, the first guiding structure 68 is a protuberance, and the second guiding structure 70 is a slot with a boundary, wherein the slot extends transversely with respect to the longitudinal length direction of the first rail 22 and the protuberance 68 is smaller than, and inserted in a portion of, the slot.

The operating member 54 is configured to transversely displace, and thereby adjust, the second component 52 with respect to the first rail 22. More specifically, the operating member 54 is configured to transversely displace, and thereby adjust, the second component 52 with respect to the longitudinal length direction of the first rail 22 (or with respect to the longitudinal wall 23 of the first rail 22). Preferably, the operating member 54 is configured to transversely displace, and thereby adjust, the second component 52 through eccentric adjustment. Preferably, the operating member 54 includes a first portion 54*a*, a second portion 54*b*, and an operating portion 54*c*. The first portion 54*a* is a substantially circular protrusion, and the second portion 54*b* is connected to the first portion 54*a* at a position other than the center of circle of the first portion 54*a*. One of the first component 50 and the second component 52 (e.g., the second component 52) includes a first structure 72, and the other of the first component 50 and the second component 52 (e.g., the first component 50) includes a second structure 74. For example, the first structure 72 is a first hole, and the second structure 74 is a second hole, wherein the second hole is smaller than the first hole. The first portion 54*a* of the operating member 54 is inserted in the first structure 72, and the second portion 54*b* of the operating member 54 is inserted in the second structure 74. Preferably, the second hole is a longitudinal hole, and the second portion 54*b* of the operating member 54 is slightly smaller than the second structure 74. The operating portion 54*c* is, for example, a rod or extension arm with which a user can easily apply a force to the operating member 54 to rotate the operating member 54. Preferably, the operating member 54 and the second component 52 are so designed that a protrusion 76 can work with a plurality of arcuately arranged recesses (or holes) 78 to keep the operating member 54 at any one of a plurality of predetermined positions with respect to the second component 52 when the operating portion 54*c* of the operating member 54 is operated. For example, the protrusion 76 may be located on an elastic portion 54*d* of the operating member 54 so as to engage with any one of the recesses 78 in the second component 52 under the elastic force of the elastic portion 54*d*.

Figure 4:
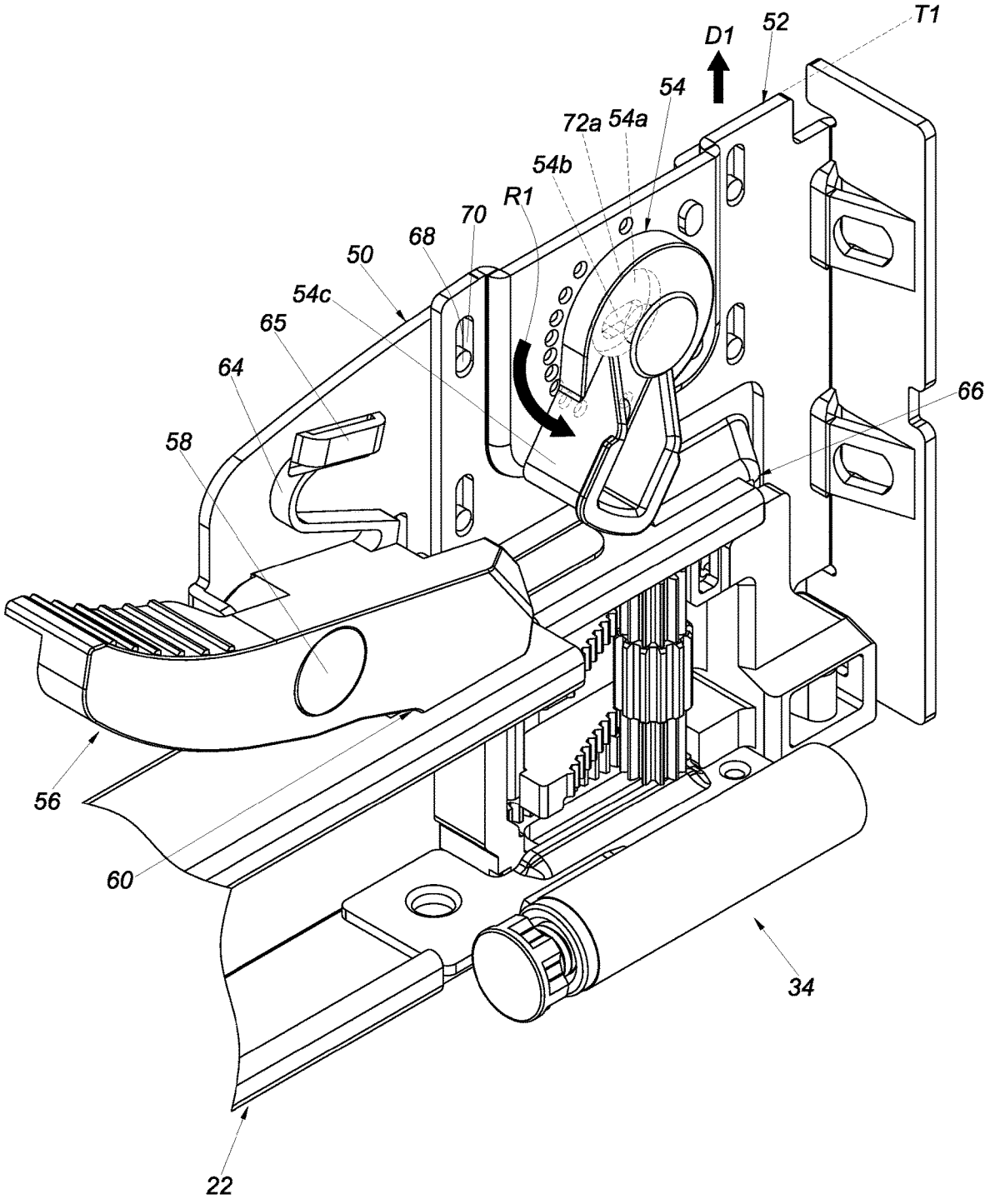
FIG. 4 is a perspective view of the connection device disposed on the first rail of the slide rail mechanism according to the embodiment of the present invention, showing a state in which the operating member of the connection device is operated in a certain direction.

Once the first component 50 is connected to the first rail 22 via the fastening portion 66 or the engaging portion 60 of the engaging member 56, as shown in FIG. 3 and FIG. 4, the first component 50 is fixed with respect to the first rail 22, but the second component 52 can be moved with respect to the first rail 22 (or the first component 50). More specifically, when a user applies a force to the operating portion 54*c* of the operating member 54 in a first rotation direction R1, the second component 52 is transversely or laterally displaced with respect to the first rail 22 in a first direction D1 from a predetermined position T0 (see FIG. 3) to a first position T1 (see FIG. 4) in response to the movement of the operating member 54 in the first rotation direction R1. For example, when the operating member 54 is moved in the first rotation direction R1, the first portion 54*a* of the operating member 54 pushes the wall 72*a* of the first structure 72 of the second component 52 and thereby displaces the second component 52 transversely or laterally with respect to the first rail 22 in the first direction D1.

Figure 5:
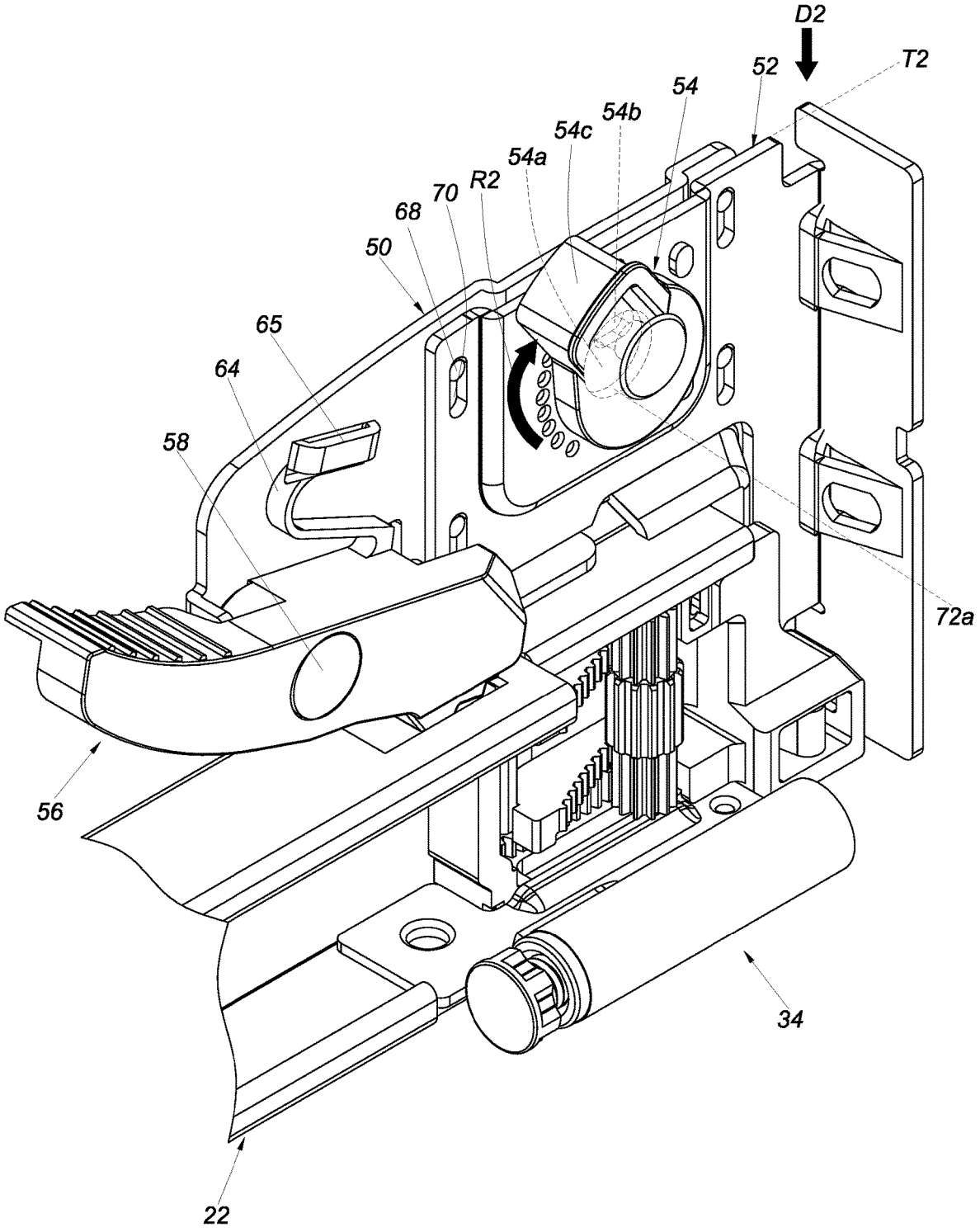
FIG. 5 is a perspective view of the connection device disposed on the first rail of the slide rail mechanism according to the embodiment of the present invention, showing a state in which the operating member of the connection device is operated in the opposite direction.

Referring to FIG. 5 in conjunction with FIG. 3, when the user applies a force to the operating portion 54*c* of the operating member 54 in a second rotation direction R2, the second component 52 is transversely or laterally displaced with respect to the first rail 22 in a second direction D2 (which is the opposite direction of the first direction D1) from the predetermined position T0 (see FIG. 3) to a second position T2 (see FIG. 5) in response to the movement of the operating member 54 in the second rotation direction R2. For example, when the operating member 54 is moved in the second rotation direction R2, the first portion 54*a* of the operating member 54 pushes the wall 72*a* of the first structure 72 of the second component 52 and thereby displaces the second component 52 transversely or laterally with respect to the first rail 22 in the second direction D2.

Figure 6:
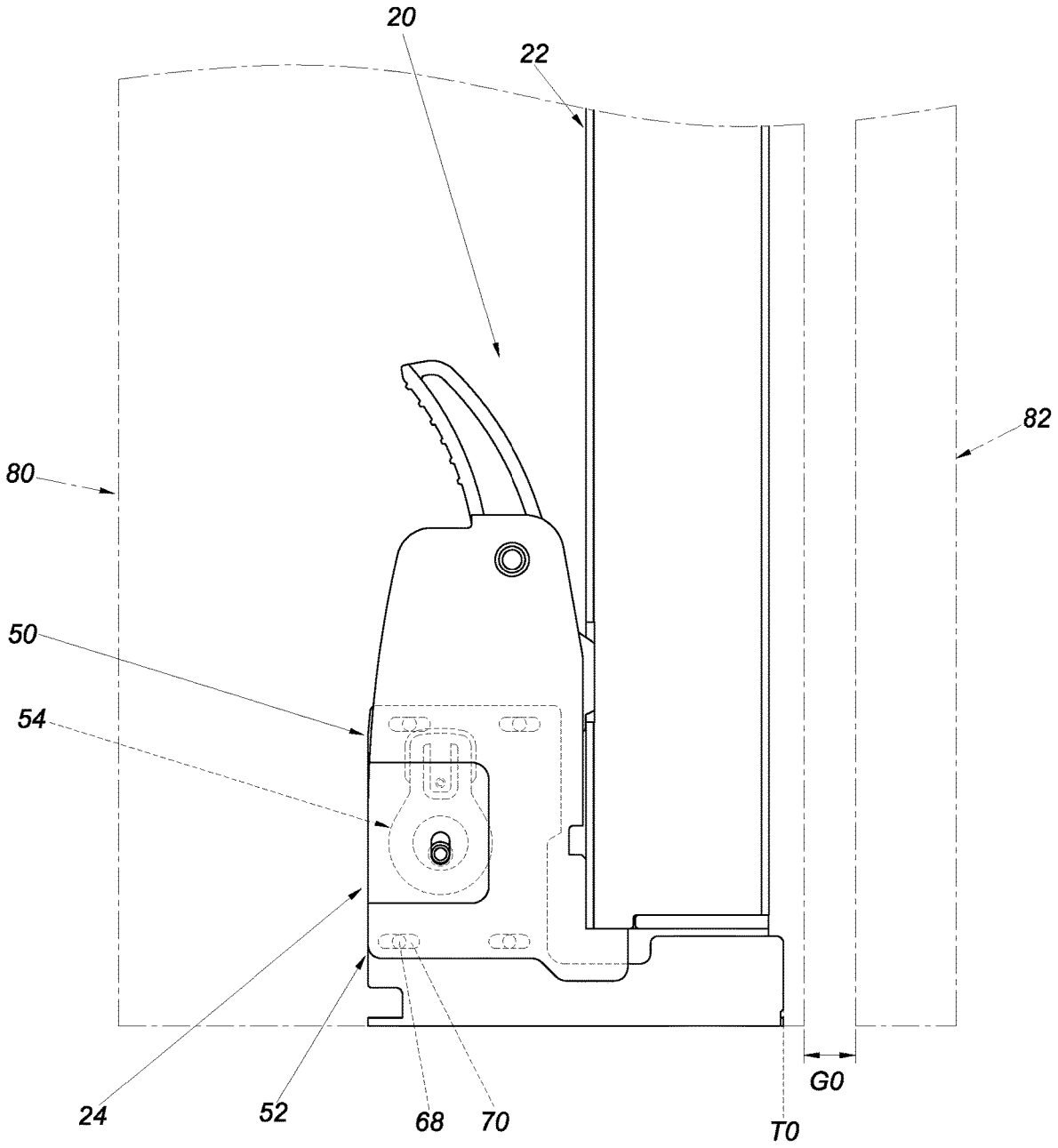
FIG. 6 is a schematic view of the slide rails of the slide rail mechanism according to the embodiment of the present invention, showing that the slide rails are applied to a piece of furniture and the operating member of the connection device have yet to be operated.

Referring to FIG. 6, the slide rail mechanism 20 is applied to a piece of furniture that includes a first furniture part 80 (e.g., a drawer) and a second furniture part 82 (e.g., the body of a cabinet). More specifically, the first rail 22 is used to carry a bottom portion of the first furniture part 80, the first component 50 of the connection device 24 is connected to the first rail 22, and the second component 52 is fixed on the first furniture part 80 by threaded connection, riveting, or mechanical engagement. The second rail 26 (not shown in FIG. 6) is fixed on the second furniture part 82.

Figure 7:
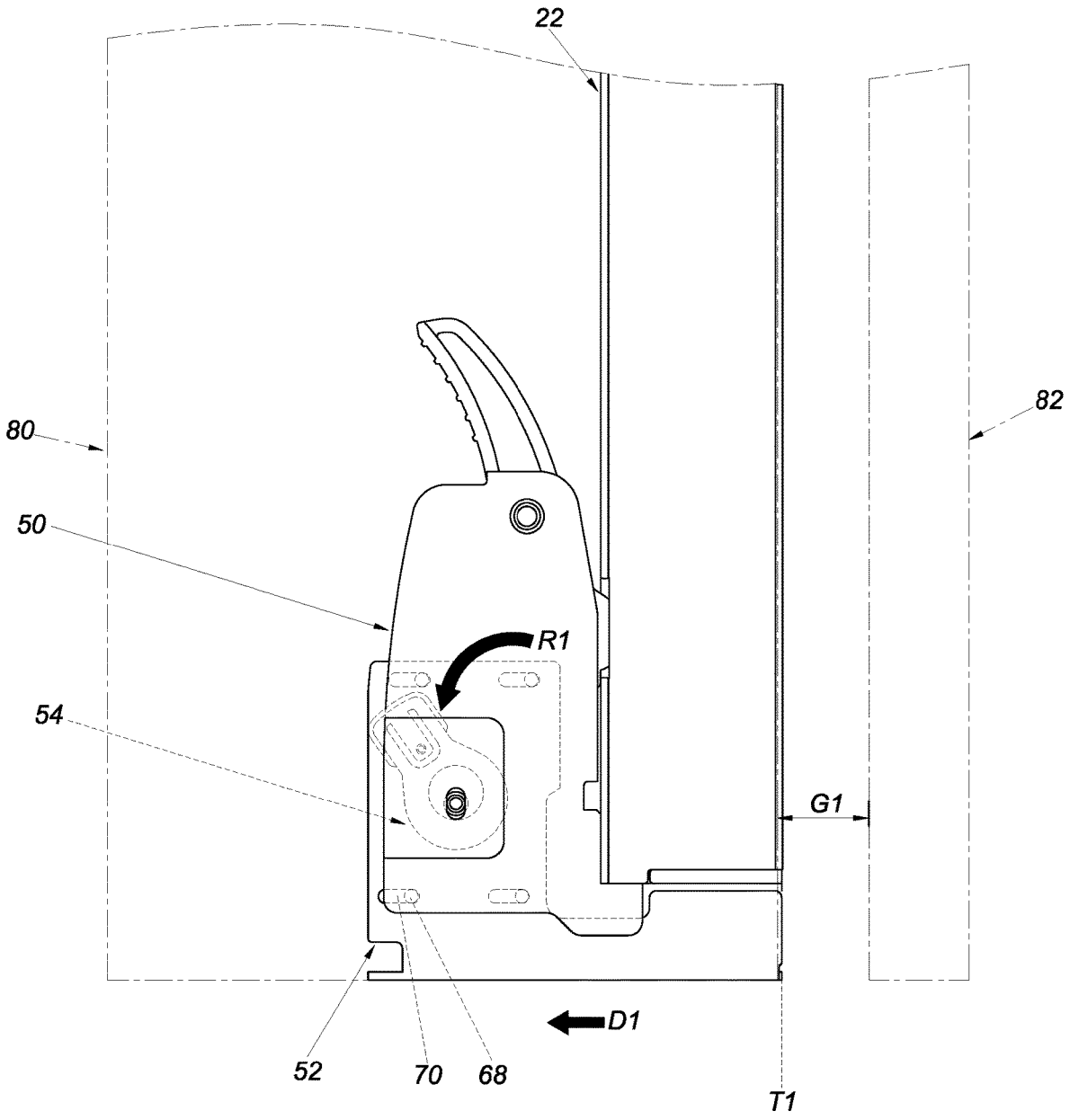
FIG. 7 is a schematic view of the slide rails of the slide rail mechanism according to the embodiment of the present invention, showing that the slide rails are applied to the furniture and the operating member of the connection device is operated to adjust the position of a first furniture part of the furniture with respect to a second furniture part in a first direction.

Referring to FIG. 7 in conjunction with FIG. 6, when the user applies a force to the operating member 54 in the first rotation direction R1, the second component 52 and the first furniture part 80 are transversely or laterally displaced with respect to the first rail 22 in the first direction D1 from the predetermined position T0 (see FIG. 6) to the first position T1 (see FIG. 7) in response to the movement of the operating member 54 in the first rotation direction R1. As a result, the distance between the corresponding sidewalls of the first furniture part 80 and the second furniture part 82 is adjusted from a predetermined distance G0 (see FIG. 6) to a first distance G1 (see FIG. 7), wherein the first distance G1 is greater than the predetermined distance G0.

Figure 8:
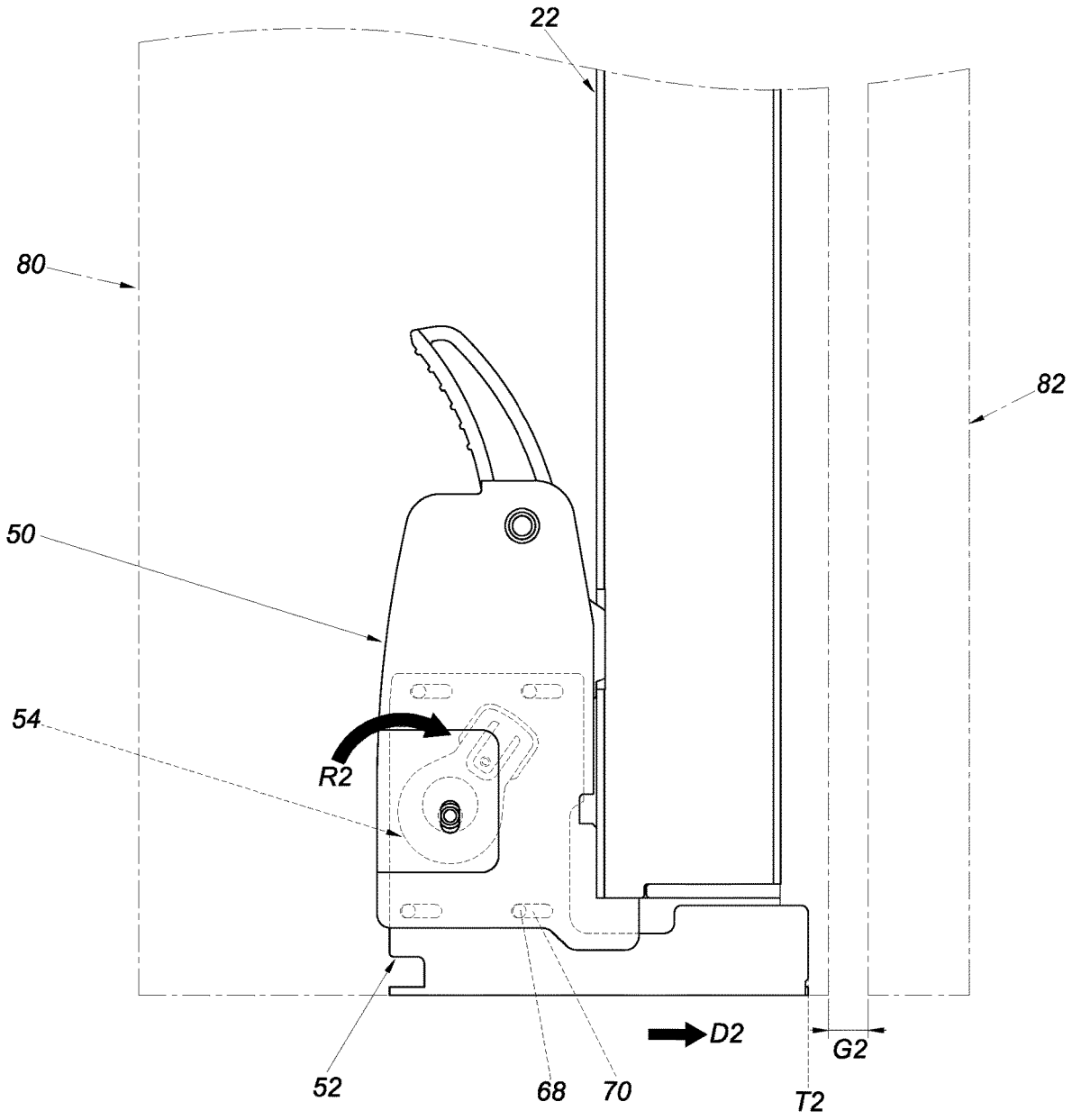
FIG. 8 is a schematic view of the slide rails of the slide rail mechanism according to the embodiment of the present invention, showing that the slide rails are applied to the furniture and the operating member of the connection device is operated to adjust the position of the first furniture part of the furniture with respect to the second furniture part in a second direction.

Referring to FIG. 8 in conjunction with FIG. 6, when the user applies a force to the operating member 54 in the second rotation direction R2 instead, the second component 52 and the first furniture part 80 are transversely or laterally displaced with respect to the first rail 22 in the second direction D2 from the predetermined position T0 (see FIG. 6) to the second position T2 (see FIG. 8) in response to the movement of the operating member 54 in the second rotation direction R2. As a result, the distance between the corresponding sidewalls of the first furniture part 80 and the second furniture part 82 is adjusted from the predetermined distance G0 (see FIG. 6) to a second distance G2 (see FIG. 8), wherein the second distance G2 is smaller than the predetermined distance G0.

Figure 9:
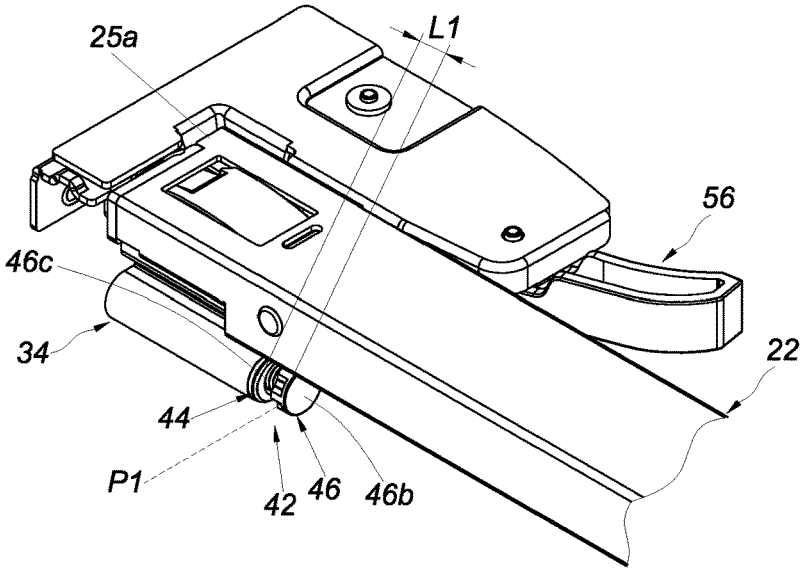
FIG. 9 shows in particular a first implemented example of the adjustment device of the slide rail mechanism according to the embodiment of the present invention, with the adjustment device attached to the first rail and being in a first state.

As shown in FIG. 9, the base 34 is connected to the first rail 22 at a position adjacent to the front portion 25*a*. Before the adjusting element 46 is adjusted with respect to the mounting element 44, the adjustment device 42 has a first length L1 outside the base 34. The adjusting element 46 in this state is at a certain position, e.g., a first longitudinal position P1, with respect to the mounting element 44.

Figure 10:
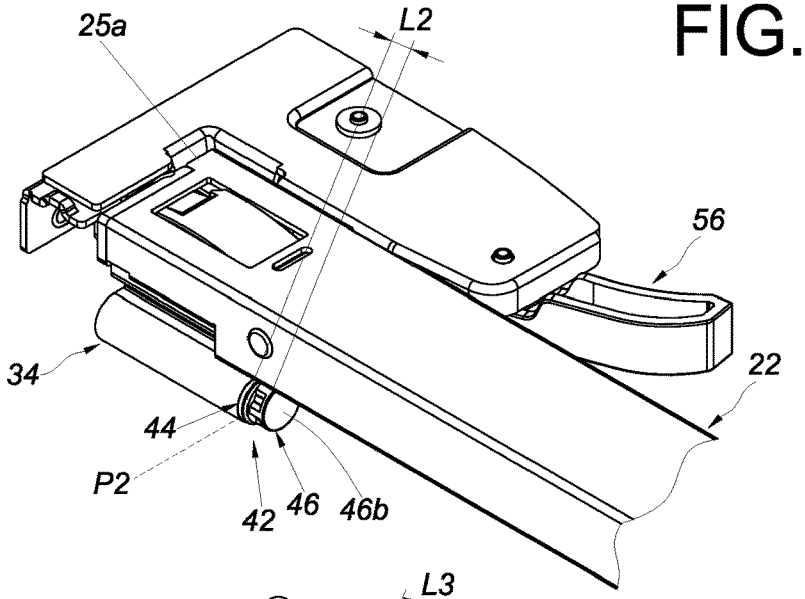
FIG. 10 shows in particular the first implemented example of the adjustment device of the slide rail mechanism according to the embodiment of the present invention, with the adjustment device being in a second state.

In FIG. 10, the adjusting element 46 is rotated, e.g., clockwise, with respect to the mounting element 44 such that the length by which the adjustment device 42 extends out of the base 34 is adjusted to a second length L2. The adjusting element 46 in this state is at another position, e.g., a second longitudinal position P2, with respect to the mounting element 44.

Figure 11:
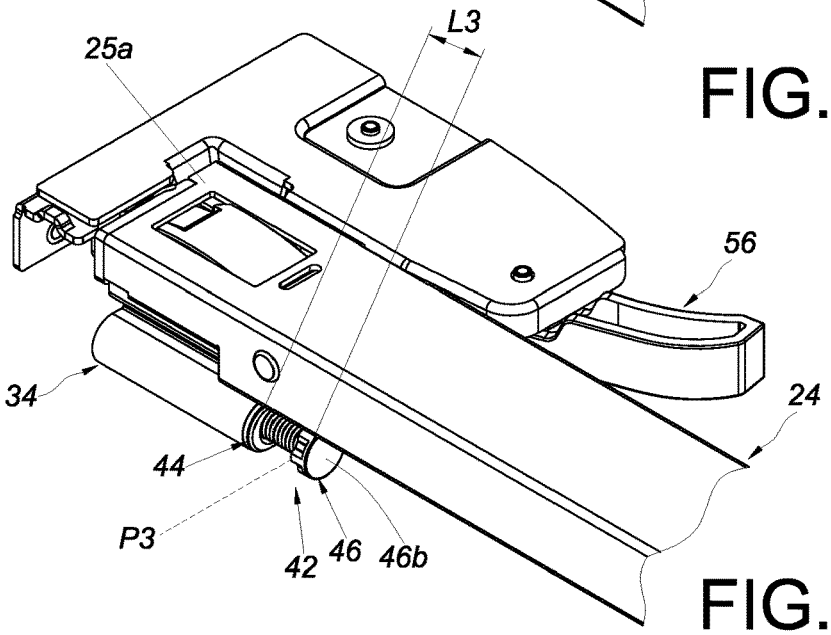
FIG. 11 shows in particular the first implemented example of the adjustment device of the slide rail mechanism according to the embodiment of the present invention, with the adjustment device being in a third state.

In FIG. 11, the adjusting element 46 is rotated, e.g., counterclockwise, with respect to the mounting element 44; as a result, the length by which the adjustment device 42 extends out of the base 34 is adjusted to a third length L3. The adjusting element 46 in this state is at yet another position, e.g., a third longitudinal position P3, with respect to the mounting element 44.

The first longitudinal position P1, the second longitudinal position P2, and the third longitudinal position P3 are different positions. The first length L1, the second length L2, and the third length L3 are different lengths.

Figure 12:
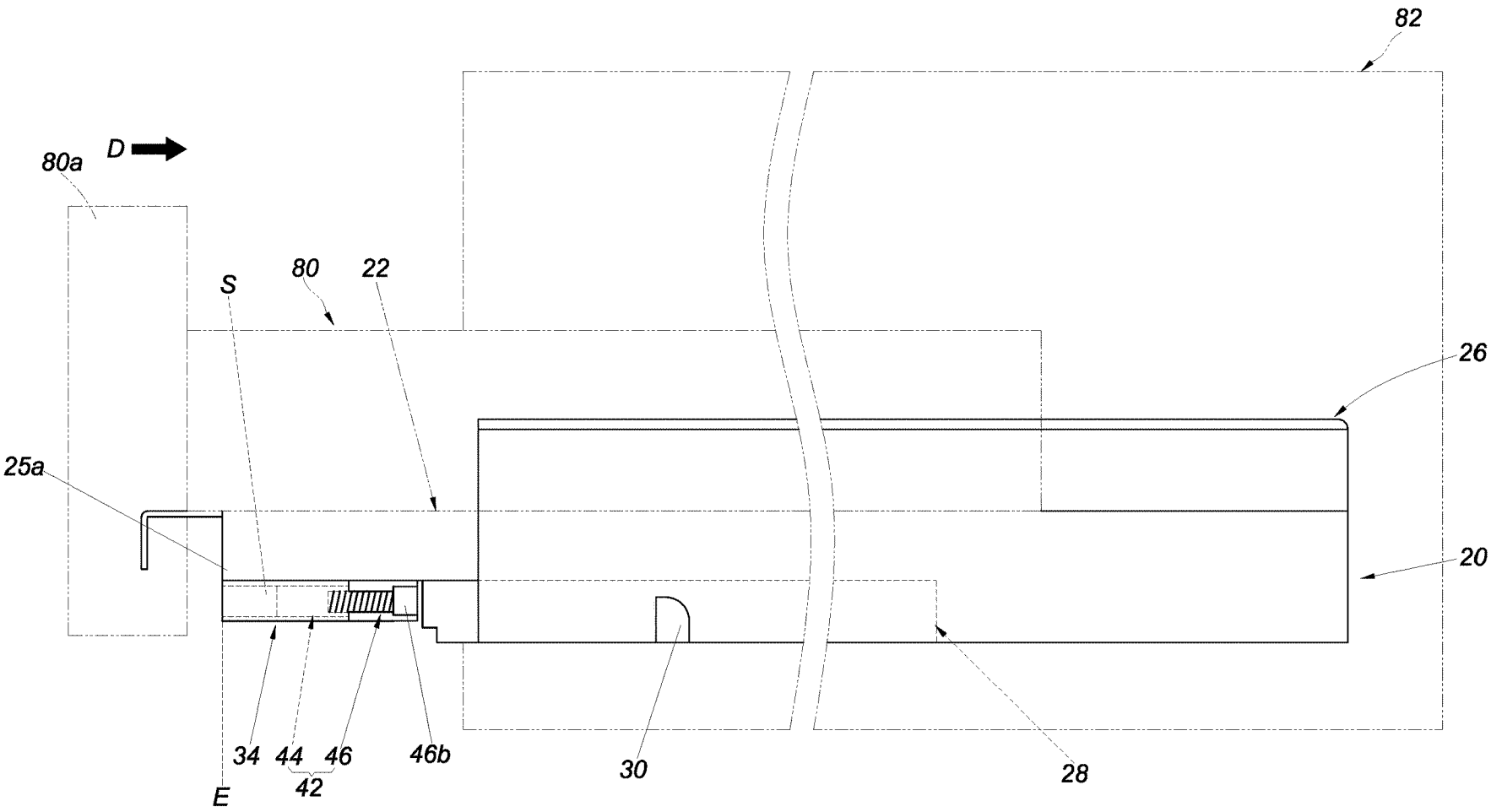
FIG. 12 is a schematic view of the slide rail mechanism according to the embodiment of the present invention, showing that the slide rail mechanism is applied to the furniture and the first rail of the slide rail mechanism is at an extended position with respect to the second rail.

Referring to FIG. 12, the first furniture part 80 includes a front panel 80*a*. The second rail 26 is fixedly mounted on the second furniture part 82 and therefore can be viewed as a portion of the second furniture part 82. The first rail 22, on the other hand, carries the bottom portion of the first furniture part 80 and therefore can be viewed as a portion of the first furniture part 80. When the first rail 22 is at the extended position E with respect to the second rail 26, the adjusting element 46 is spaced apart from the stopping structure 30 of the second rail 26.

Figure 13:
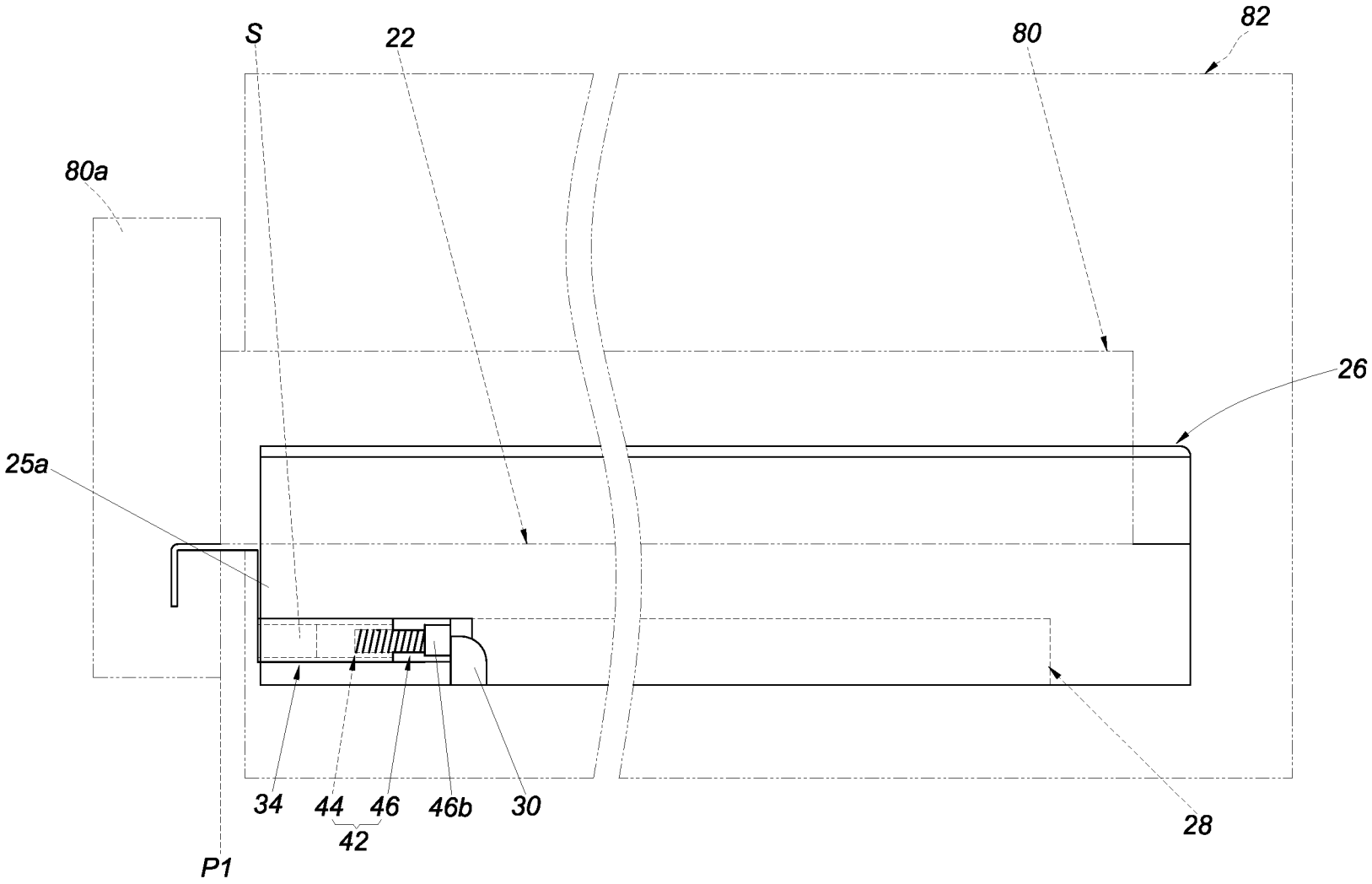
FIG. 13 is a schematic view showing that the second rail of the slide rail mechanism according to the embodiment of the present invention is retracted with respect to the first rail, and that the adjustment device employed in accordance with the first implemented example is in the first state.

As shown in FIG. 12 and FIG. 13, the adjustment device 42 can be used and mounted in the base 34 to provide the furniture or the slide rail mechanism 20 with a depth adjustment function or to serve as an adjustment mechanism for compensating for engineering tolerances of the second rail 26 (or the second furniture part 82) and the first rail 22 (or the first furniture part 80) (referred to collectively as to satisfy the first need).

More specifically, once the adjustment device 42 is mounted in the base 34, and before the adjusting element 46 is adjusted with respect to the mounting element 44 (or the base 34, which in other embodiments may be provided with a screw thread structure matching that of the adjusting element 46), i.e., when the adjustment device 42 has the first length L1, retracting the first rail 22 with respect to the second rail 26 from the extended position E in a retracting direction D (until full retraction is achieved, for example) will bring the head 46*b* of the adjusting element 46 into abutment against the stopping structure 30 (see FIG. 13) such that the first rail 22 arrives at a certain longitudinal position (indicated as the foregoing first longitudinal position P1 for example) with respect to the second rail 26.

Figure 14:
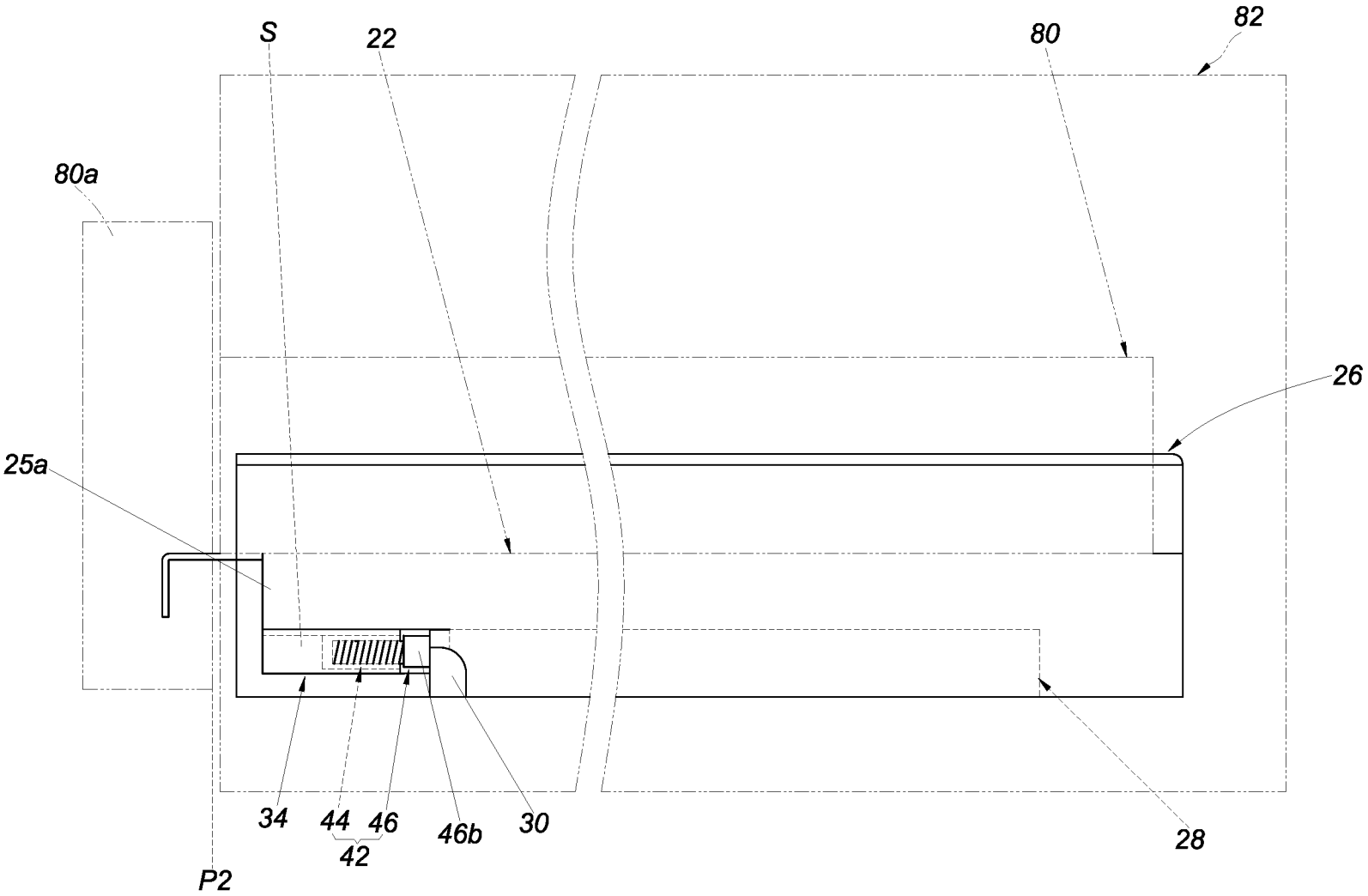
FIG. 14 is a schematic view showing that the second rail of the slide rail mechanism according to the embodiment of the present invention is retracted with respect to the first rail, and that the adjustment device employed in accordance with the first implemented example is in the second state.

Referring to FIG. 14, when the adjusting element 46 is adjusted with respect to the mounting element 44 or the base 34 in such a way that the adjustment device 42 has the second length L2, retracting the first rail 22 with respect to the second rail 26 from the extended position E in the retracting direction D (until full retraction is achieved, for example) will bring the head 46*b* of the adjusting element 46 into abutment against the stopping structure 30 too, but in this case the first rail 22 will end up at another longitudinal position (indicated as the foregoing second longitudinal position P2 for example) with respect to the second rail 26.

Figure 15:
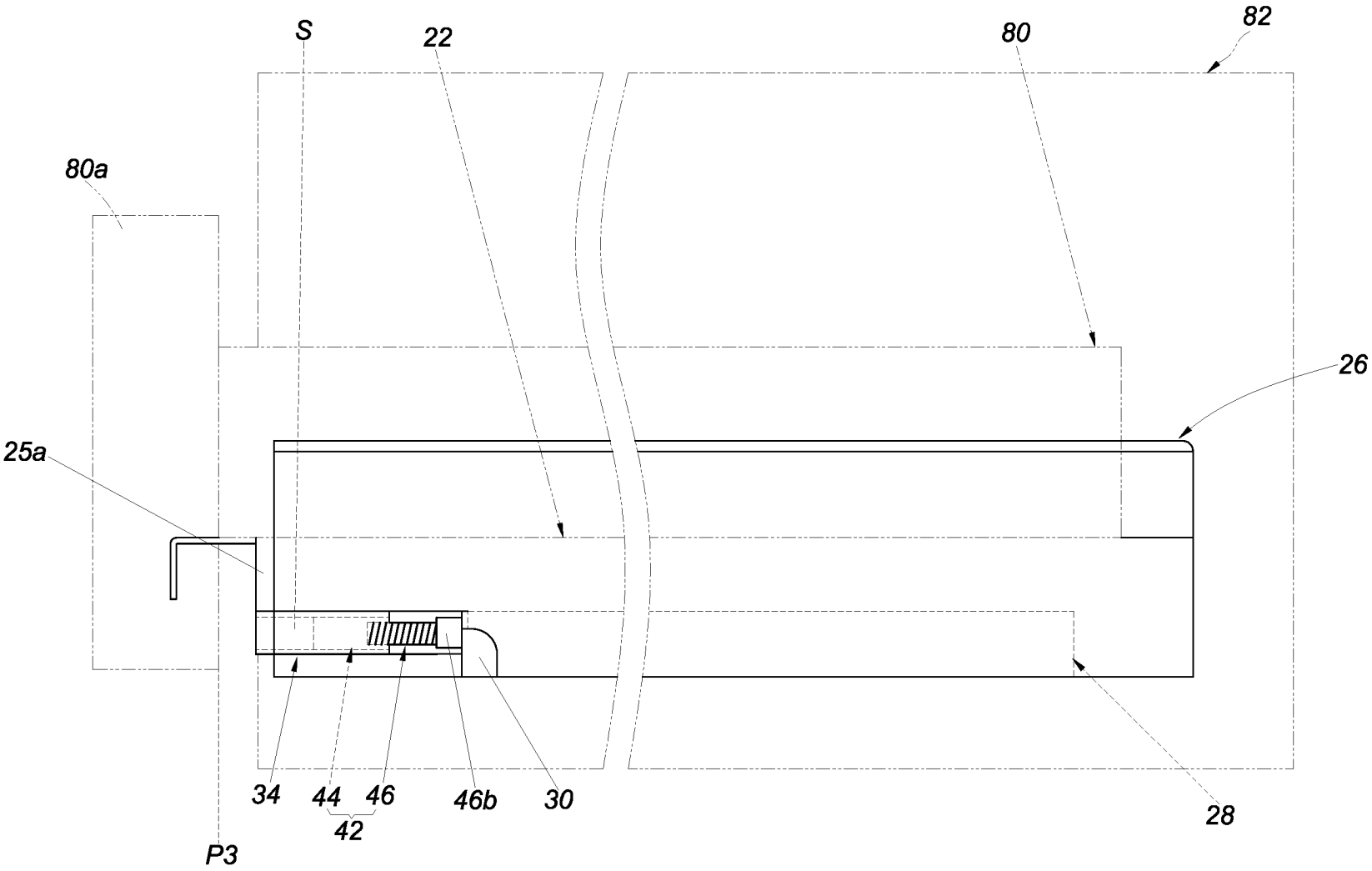
FIG. 15 is a schematic view showing that the second rail of the slide rail mechanism according to the embodiment of the present invention is retracted with respect to the first rail, and that the adjustment device employed in accordance with the first implemented example is in the third state.

Referring to FIG. 15, when the adjusting element 46 is adjusted with respect to the mounting element 44 or the base 34 in such a way that the adjustment device 42 has the third length L3, retracting the first rail 22 with respect to the second rail 26 from the extended position E in the retracting direction D (until full retraction is achieved, for example) will also bring the head 46*b* of the adjusting element 46 into abutment against the stopping structure 30, but in this case the first rail 22 will arrive at yet another longitudinal position (indicated as the foregoing third longitudinal position P3 for example) with respect to the second rail 26.

It can be known from the above that, by adjusting the length of the adjustment device 42 and bringing the adjustment device 42 into abutment against the stopping structure 30, the first rail 22 can be stopped at different longitudinal positions (i.e., at different depths) (e.g., at the first longitudinal position P1, the second longitudinal position P2, or the third longitudinal position P3) when retracted with respect to the second rail 26. It should be noted that, if the adjusting element 46 of the adjustment device 42 is not adjusted with respect to the mounting element 44 according to the first need such that the adjustment device 42 keeps having a certain length (e.g., the first length L1), the first rail 22 will reach the same longitudinal position (e.g., the first longitudinal position P1) with respect to the second rail 26 each time the adjusting element 46 is brought into abutment against the stopping structure 30 by retracting the first rail 22 with respect to the second rail 26 from the extended position E in the retracting direction D (until full retraction is achieved, for example). That is to say, the adjusting element 46 must be adjusted with respect to the mounting element 44 in order for the first rail 22 to arrive at a longitudinal position other than the first longitudinal position P1 (e.g., the second longitudinal position P2 or the third longitudinal position P3) when retracted with respect to the second rail 26.

Figure 16:
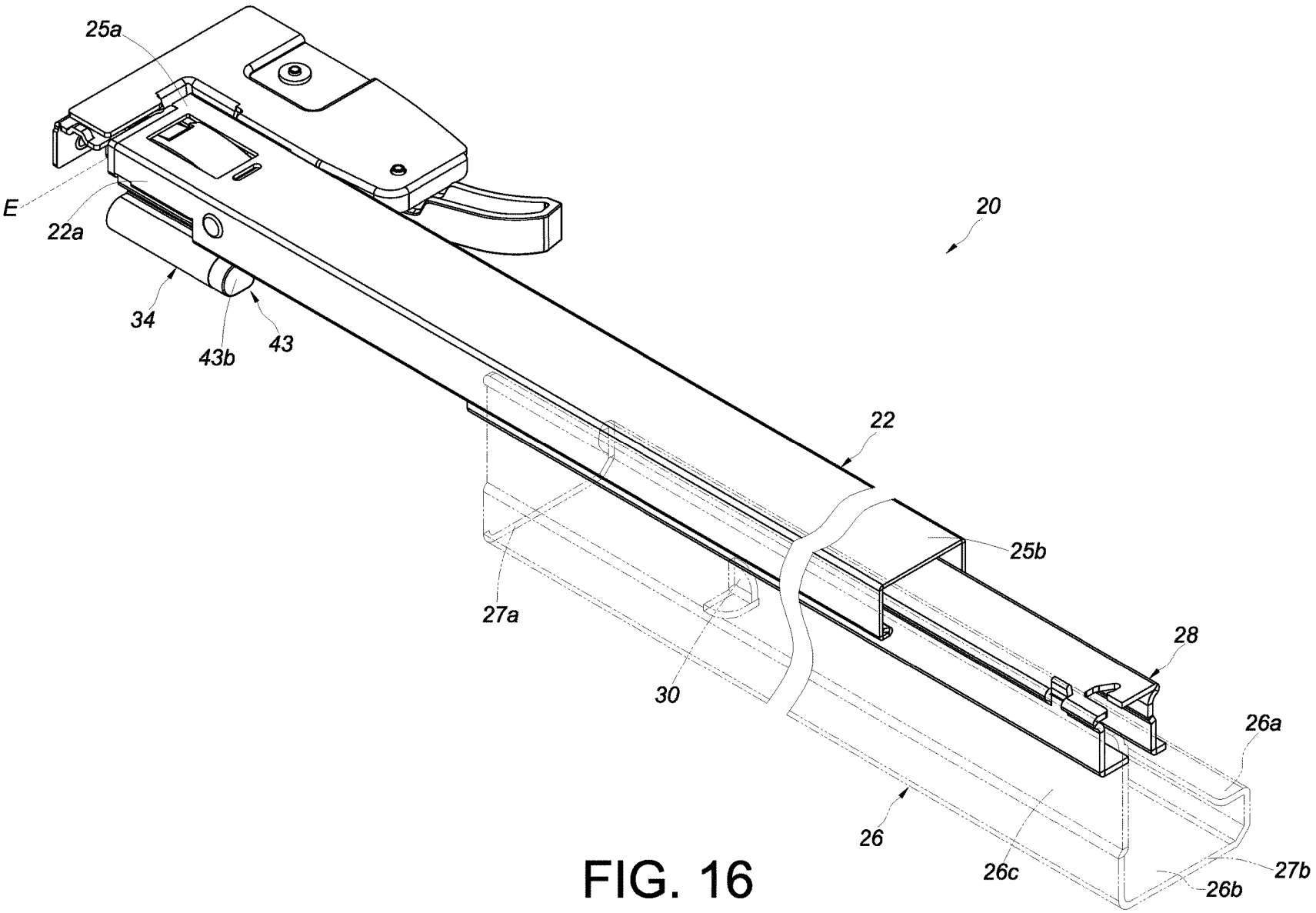
FIG. 16 is a perspective view showing in particular a second implemented example of the adjustment device of the slide rail mechanism according to the embodiment of the present invention.

Referring to FIG. 16, if the adjustment device 42 is mounted in the base 34 in advance, a user may detach the adjustment device 42 from the base 34 and then mount a stopper 43 (which is included in the fitting) into the base 34 in a detachable manner at the same position where the adjustment device 42 was. In other words, the stopper 43 or the adjustment device 42 of the fitting can be mounted in the base 34 selectively according to user needs. More specifically, the stopper 43 can be mounted in the base 34 to keep the first rail 22 at substantially the same position with respect to the second rail 26 when retracted or to reduce noise (referred to collectively as to satisfy the second need). It is worth mentioning that all the other components (e.g., the first rail 22, the second rail 26, the stopping structure 30, and the base 34) of the slide rail mechanism 20 in FIG. 16 are arranged in the same way as stated above; for the sake of brevity, therefore, the arrangement will not be described repeatedly.

Figure 17:
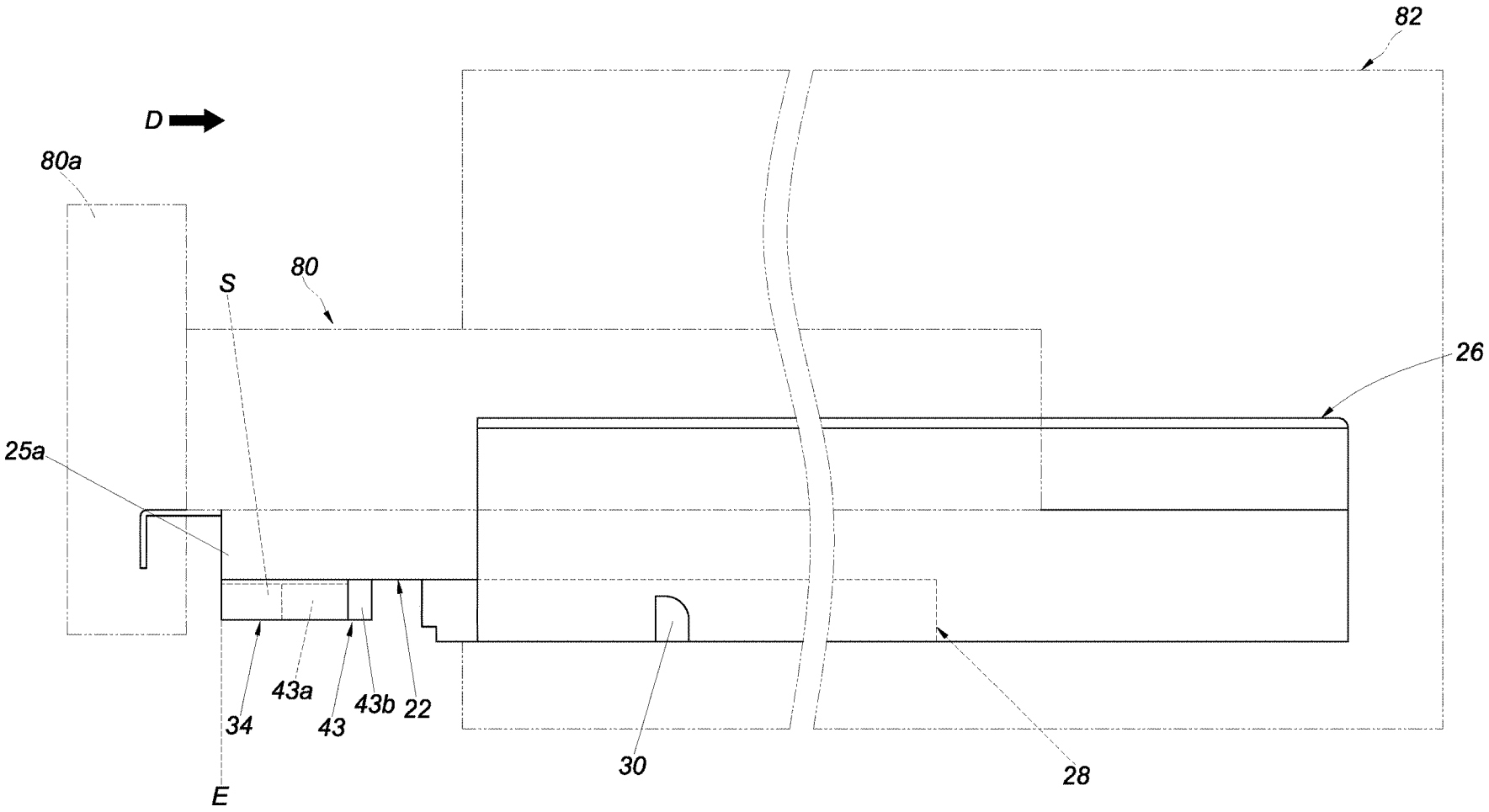
FIG. 17 is a schematic view of the slide rail mechanism according to the embodiment of the present invention, showing that the slide rail mechanism is applied to the furniture and employs the adjustment device in accordance with the second implemented example, and that the first rail of the slide rail mechanism is at an extended position with respect to the second rail.
Figure 18:
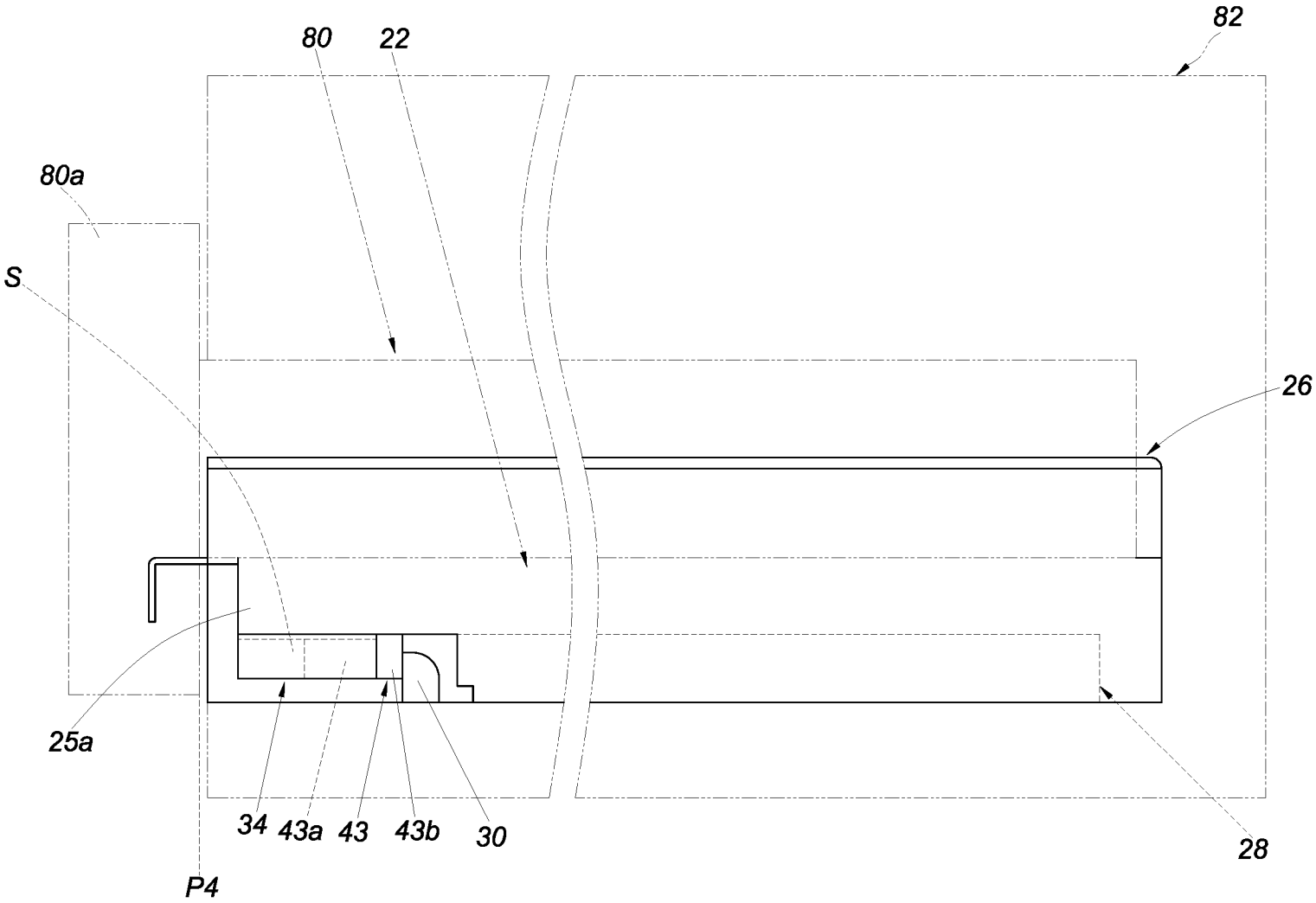
FIG. 18 is a schematic view of the slide rail mechanism according to the embodiment of the present invention, showing that the slide rail mechanism employs the adjustment device in accordance with the second implemented example, and that the second rail of the slide rail mechanism is retracted with respect to the first rail.

As shown in FIG. 17 and FIG. 18, the stopper 43 is mounted in the space S of the base 34. The stopper 43 is detachably mounted in the base 34. For example, the stopper 43 includes a first portion 43*a* to be mounted in the space S. Preferably, the stopper 43 further includes a second portion 43*b* connected to the first portion 43*a*, and the second portion 43*b* is larger than the first portion 43*a* and the space S. Once the first portion 43*a* is mounted in the space S, the second portion 43*b* stays outside the space S of the base 34. Preferably, the stopper 43 includes a non-metallic material. For example, the stopper 43 includes plastic or a flexible material.

When the stopper 43 is mounted in the base 34, retracting the first rail 22 with respect to the second rail 26 from the extended position E in the retracting direction D (until full retraction is achieved, for example) will bring the stopper 43 (e.g., the second portion 43*b*) into abutment against the stopping structure 30 so that the first rail 22 always reaches the same longitudinal position (i.e., the same depth) (e.g., a fourth longitudinal position P4) with respect to the second rail 26. In other words, each time the first rail 22 is retracted with respect to the second rail 26 from the extended position E in the retracting direction D (until full retraction is achieved, for example), the stopper 43 will abut against the stopping structure 30 to ensure that the first rail 22 substantially always arrives at the fourth longitudinal position P4 with respect to the second rail 26. In addition, when the first rail 22 is retracted to the fourth longitudinal position P4 with respect to the second rail 26, the stopper 43, which includes plastic or a flexible material, can reduce the noise of collision or produce a buffering effect upon abutment against the stopping structure 30.

According to the above, the slide rail mechanism of the present invention preferably has the following features:

1. The first component 50 of the connection device 24 is connectable to the first rail 22, and the second component 52 of the connection device 24 is laterally or transversely movable with respect to the first component 50 or the first rail 22. This arrangement enables the second component 52 to adjust the lateral or transverse position of the first furniture part 80 with respect to the second rail 26 or the second furniture part 82.
2. A user may selectively mount the adjustment device 42 of the fitting on a slide rail, in order for the slide rail to reach different positions with respect to another slide rail in response to adjustment in length of the adjustment device 42, thereby satisfying different needs. Or the user may selectively mount the stopper 43 of the fitting on the first mentioned slide rail instead, in order for the first mentioned slide rail to reach substantially the same position when retracted with respect to the second mentioned slide rail, or with a view to reducing the noise of collision or producing a buffering effect.
3. By adjusting the length of the adjustment device 42 and having the adjustment device 42 abut against the stopping structure 30, the first furniture part 80 of the furniture (or the first rail 22) can be stopped at different longitudinal positions when retracted with respect to the second furniture part 82 (or the second rail 26). The present invention features structural simplicity and can meet specific operational demands on the market.

While the present invention has been disclosed through the preferred embodiments described above, the embodiments are not intended to be restrictive of the scope of the invention. The scope of patent protection sought by the applicant is defined by the appended claims.

What is claimed is:

1. A slide rail mechanism, comprising:

a slide rail; and a connection device including:

a first component detachably connected to the slide rail;

an engaging member pivotally mounted on the first component, the first component being detachably connected to the slide rail via the engaging member, wherein the engaging member includes at least one engaging portion for engaging with a corresponding structure of the slide rail and an elastic portion pressing the engaging member against the first component;

a second component movable with respect to the first component; and an operating member configured for transversely displacing, and thereby adjusting, the second component with respect to a longitudinal length direction of the slide rail, wherein one of the operating member and the second component includes a protrusion, and the other of the operating member and the second component includes a plurality of recesses, the protrusion being configured to engage a selected one of the recesses to releasably lock the operating member at a corresponding one of a plurality of predetermined positions relative to the second component.

2. The slide rail mechanism of claim 1, wherein the first component includes a fastening portion configured to be fastened to the slide rail at a position adjacent to a front portion of the slide rail.

3. The slide rail mechanism of claim 1, wherein the first component and the second component are transversely displaceable with respect to each other to a limited extent through cooperation between a first guiding structure and a second guiding structure.

4. The slide rail mechanism of claim 3, wherein:
the first guiding structure is a protuberance,
the second guiding structure is a slot, and
the protuberance is smaller than the slot.

5. The slide rail mechanism of claim 1, further comprising another slide rail, with respect to which the slide rail is longitudinally displaceable;
wherein the protrusion is elastically biased to engage one of the recesses.

6. The slide rail mechanism of claim 1, wherein the operating member is configured to transversely displace, and thereby adjust, the second component through eccentric adjustment.

7. The slide rail mechanism of claim 6, wherein:
the operating member includes a first portion, a second portion, and an operating portion;
the first portion is a substantially circular protrusion;
the second portion is connected to the first portion at a position other than a center of circle of the first portion;
one of the first component and the second component includes a first structure;
the other of the first component and the second component includes a second structure;
the first portion of the operating member is inserted in the first structure; and
the second portion of the operating member is inserted in the second structure.

8. The slide rail mechanism of claim 5, wherein:
the second component is configured to be connected to a first furniture part, and
said another slide rail is configured to be connected to a second furniture part.

9. A slide rail mechanism, comprising:
a first rail;
a second rail, wherein the second rail and the first rail are longitudinally displaceable with respect to each other; and
a connection device including:
a first component connected to the first rail;
an engaging member pivotally connected to the first component, the first component being connected to the first rail via the engaging member, wherein the engaging member includes at least one engaging portion for engaging with a corresponding structure of the first rail and an elastic portion pressing the engaging member against the first component;
a second component movable with respect to the first component; and
an operating member configured for laterally displacing, and thereby adjusting, the second component with respect to the first rail,
wherein one of the operating member and the second component includes a protrusion, and the other of the operating member and the second component includes a plurality of recesses, the protrusion being configured to engage a selected one of the recesses to releasably lock the operating member at a corresponding one of a plurality of predetermined positions relative to the second component.

10. The slide rail mechanism of claim 9, wherein the first component and the second component are displaceable with respect to each other to a limited extent through cooperation between a first guiding structure and a second guiding structure.

11. The slide rail mechanism of claim 9, further comprising a stopping structure disposed on one of the first rail and the second rail and a fitting detachably mounted on the other of the first rail and the second rail,
wherein when the fitting is mounted on the other of the first rail and the second rail, and the first rail is retracted with respect to the second rail, the fitting is brought into abutment against the stopping structure in order for the first rail to be at one of a plurality of different longitudinal positions with respect to the second rail or at a same longitudinal position with respect to the second rail.

12. The slide rail mechanism of claim 11, further comprising a base, wherein:
the base is connected to the other of the first rail and the second rail, and
the fitting is detachably mounted at the base.

13. The slide rail mechanism of claim 12, wherein:
the fitting includes an adjustment device,
the adjustment device includes an adjusting element,
the adjusting element is adjustably mounted at the base, and
when the first rail is retracted with respect to the second rail, the adjusting element is brought into abutment against the stopping structure.

14. The slide rail mechanism of claim 13, wherein:
the adjustment device includes a mounting element,
the adjusting element is mounted at the base via the mounting element, and
the mounting element and the adjusting element are threadedly connected with respect to each other.

15. The slide rail mechanism of claim 12, wherein the fitting includes a stopper; and when the stopper is mounted at the base, and the first rail is retracted with respect to the second rail, the stopper is brought into abutment against the stopping structure in order for the first rail to be at the same longitudinal position with respect to the second rail.

* * * * *